US005337040A

United States Patent [19]

Kind

[11] Patent Number: 5,337,040

[45] Date of Patent: Aug. 9, 1994

[54] DETECTION APPARATUS FOR SHOPLIFTING-PREVENTING LABELS

[75] Inventor: Burckart Kind, Zürich, Switzerland

[73] Assignee: Actron Entwicklungs AG, Rotkreuz, Switzerland

[21] Appl. No.: 959,991

[22] Filed: Oct. 13, 1992

[30] Foreign Application Priority Data

Oct. 31, 1991 [CH] Switzerland ..... 03 185/91-1
Apr. 3, 1992 [CH] Switzerland ..... 01 098/92-3
Aug. 4, 1992 [CH] Switzerland ..... 02 446/92-5

[51] Int. Cl.[5] ..... G08B 13/24
[52] U.S. Cl. ..... 340/572; 340/551
[58] Field of Search ..... 340/572, 551

[56] References Cited

U.S. PATENT DOCUMENTS 4,309,697 1/1982 Weaver ..... 340/551
4,623,877 11/1986 Buckens ..... 340/551
4,797,659 1/1989 Larsen ..... 340/572
4,870,391 9/1989 Cooper ..... 340/551
5,153,562 10/1992 van Breemen ..... 340/572

*Primary Examiner*—Glen Swann

*Attorney, Agent, or Firm*—Tarolli, Sundheim & Covell

[57] ABSTRACT

An apparatus for the detection of labels (21) used for preventing the shoplifting of articles (20) and which are provided with an electrical resonant circuit having a resonant frequency in the MHz range, comprises several pairs of transmitting and receiving antennas (8 to 13), which in each case bound passages (5 to 7) to be monitored. The transmitting antennas (8, 10, 12) of the pairs in each case radiate electromagnetic waves, whose frequency is wobbled in wobble cycles over the predetermined resonant frequency of the labels. The wobble cycles of all the pairs are synchronized with one another. To the receiving antenna (9, 11, 13) of each pair is connected a receiving circuit (17 to 19) detecting the presence of a label. For simplifying the installation, the invention proposes that the h.f.-oscillations radiated as electromagnetic waves by means of the transmitting antennas are generated by decentralized h.f.-generators (14 to 16) individually associated with the transmitting antennas and that the wobble cycles are synchronized with one another using a synchronization signal with at least one frequency in the LW-range generated in a central unit (22) and supplied to the h.f.-generators.

16 Claims, 4 Drawing Sheets

DETECTION APPARATUS FOR SHOPLIFTING-PREVENTING LABELS

TECHNICAL FIELD

The present invention relates to an apparatus for the detection of labels used for preventing shoplifting of articles and provided with an electrical resonant circuit having a resonant frequency in the MHz range, in which the apparatus comprises several pairs of transmitting and receiving antennas, which in each case bound the passages to be monitored and the transmitting antennas of the pairs in each case radiate electromagnetic waves, whose frequency is wobbled in wobble cycles over the predetermined resonant frequency of the labels, the wobble cycles of all the pairs being synchronized with one another and in which on the receiving antenna of each pair is connected a receiving circuit detecting the presence of a label.

PRIOR ART

Apparatuses of this type are known and widely used, particularly in supermarkets with a large number of juxtaposed cash registers. The receiving and transmitting antennas are generally fixed laterally to the cash register boxes and e.g. a transmitting antenna fixed to a first cash register box forms with a receiving antenna fixed to the adjacent cash register box one of the aforementioned pairs of transmitting and receiving antennas. The high frequency radiated by the transmitting antennas is centrally generated in a h.f. generator and is transmitted across corresponding, expensive high frequency cables to the individual transmitting antennas. Particularly in the case of a large number of cash registers, the cabling is very complicated and expensive.

DESCRIPTION OF THE INVENTION

The main problem of the present invention is to give an apparatus of the aforementioned type, which can be installed with reduced effort and expenditure.

This and further problems are solved, according to the present invention, by an apparatus having the features given in claim 1.

Thus, according to the invention, the h.f. oscillations radiated as electromagnetic waves by means of the transmitting antennas are generated in decentralized instead of centralized manner by first h.f. generators individually associated with the transmitting antennas. The wobble cycles are synchronized with one another using a synchronization signal generated in a central unit and supplied to the h.f. generators and having at least one frequency different from the resonant frequency $f_R$.

The decentralized h.f. generation advantageously obviates the expensive and very interference and fault-prone cabling to the high frequency cables. For the synchronization of the individual h.f. generators or the wobble cycles only one signal is centrally generated with at least one frequency and transmitted to the individual h.f. generators.

According to a preferred embodiment of the invention the synchronization signal has a carrier oscillation on which is modulated at least the desired fundamental frequency of the wobble cycles, but preferably additionally several times said fundamental frequency (e.g. 4 and 32 times the fundamental frequency). The frequency of the carrier oscillation can advantageously be used for fixing the frequency of the wobble cycles and the frequency or frequencies modulated onto the carrier oscillation can be used, after demodulation, for fixing the phase of the wobble cycles.

According to another preferred embodiment of the invention the synchronization signal required for synchronization is simply fed into the electrical mains, to which are e.g. also connected the cash registers. The at least one frequency of the synchronization signal is in the long-wave (LW) range. On lines of an electrical building installation, the LW signals have an adequate range for the present purpose. The postal authorities of many countries have made available for signal or data transmission via the electric mains in the LW-range a particular frequency band and use can advantageously be made thereof here.

For the demodulation or discrimination of the label signals in the receiving circuits provided for this purpose, it is standard practice to use a squarer at the input of the receiving circuits and in it the signal received from the receiving antennas is multiplied by itself. Label discrimination can be decisively improved if the received signal suffering from certain interference is multiplied by the pure h.f.-oscillation supplied to the particular transmitting antenna instead of with itself. For this purpose, besides being connected to the transmitting antennas, the h.f.-generators can also be connected to the receiving circuits, with which are connected the associated receiving antennas in each case. Without significant cabling expenditure, this advantageous possibility results from the decentralized arrangement of the h.f. generators.

If, as stated hereinbefore, the transmitting or receiving antennas are installed laterally on several cash register boxes arranged in a row and the associated h.f. generators or receiving circuits are located spatially directly at these and therefore on different sides of the passages between the cash register boxes bounded by the transmitting and receiving antennas, in order to be able to also connect the h.f. generators to the receiving circuits, h.f.-lines would have to cross the passages between the transmitting antennas and their associated receiving antennas. In order to avoid this, according to another preferred embodiment of the invention, the h.f.-oscillations supplied to the receiving circuits for discriminating the label signals can be generated by especially provided, once again decentralized second h.f.-generators associated individually and spatially with the receiving circuits.

Obviously, for this purpose said second h.f.-generators must be synchronized with the first h.f.-generators. However, the synchronism can be very easily obtained using the synchronization signal, preferably transmitted across the electrical mains and which is already present for synchronizing the first h.f.-generators with one another.

The second h.f.-generators, together with the receiving circuits for which they are provided, as well as optionally with the first h.f.-generator for the transmitting antenna fitted on the same cash register, can be integrated into a constructional unit. This unit is advantageously installed e.g. somewhere within the cash register box.

According to another embodiment of the invention the frequency of the signals radiated via the transmitting antennas are sinusoidally wobbled across the predetermined resonant frequency of the labels. Only the approximately linear portions of the wobble sign between the maxima and minima can be used for label detection, but not the time periods around said maxima and minima. However, these time periods can appropriately be used, e.g. for the parallel deactivation of deactivatable labels. If during the carrying out of deactivation during said time periods, the receiving circuits are put out of operation or at least switched so as not to be sensitive, then undesired influencing of the detection systems by the deactivation systems can be avoided, thereby preventing false alarms. The synchronism which is once again necessary between the detection and deactivation units can once again be obtained in simple manner using the synchronization signal already available on the electrical mains.

Finally, the electromagnetic waves radiated by the transmitting antenna of each pair can be wobbled in frequency-shifted manner over the predetermined resonant frequency of the labels compared with the electromagnetic waves radiated by the transmitting antenna of each other pair and the receiving circuit of each pair receives in narrow-band manner only on the transmitting frequency of the transmitting antenna belonging to the same pair. Assuming the same phase position of the wobble cycles of all pairs, as a result of such a frequency shift, there is a very substantial decoupling or neutralizing of the individual pairs and reciprocal influencing between the pairs is substantially eliminated.

MANNER OF PERFORMING THE INVENTION

An embodiment of the invention is described in greater detail hereinafter with reference to the attached drawings.

Figure 1:
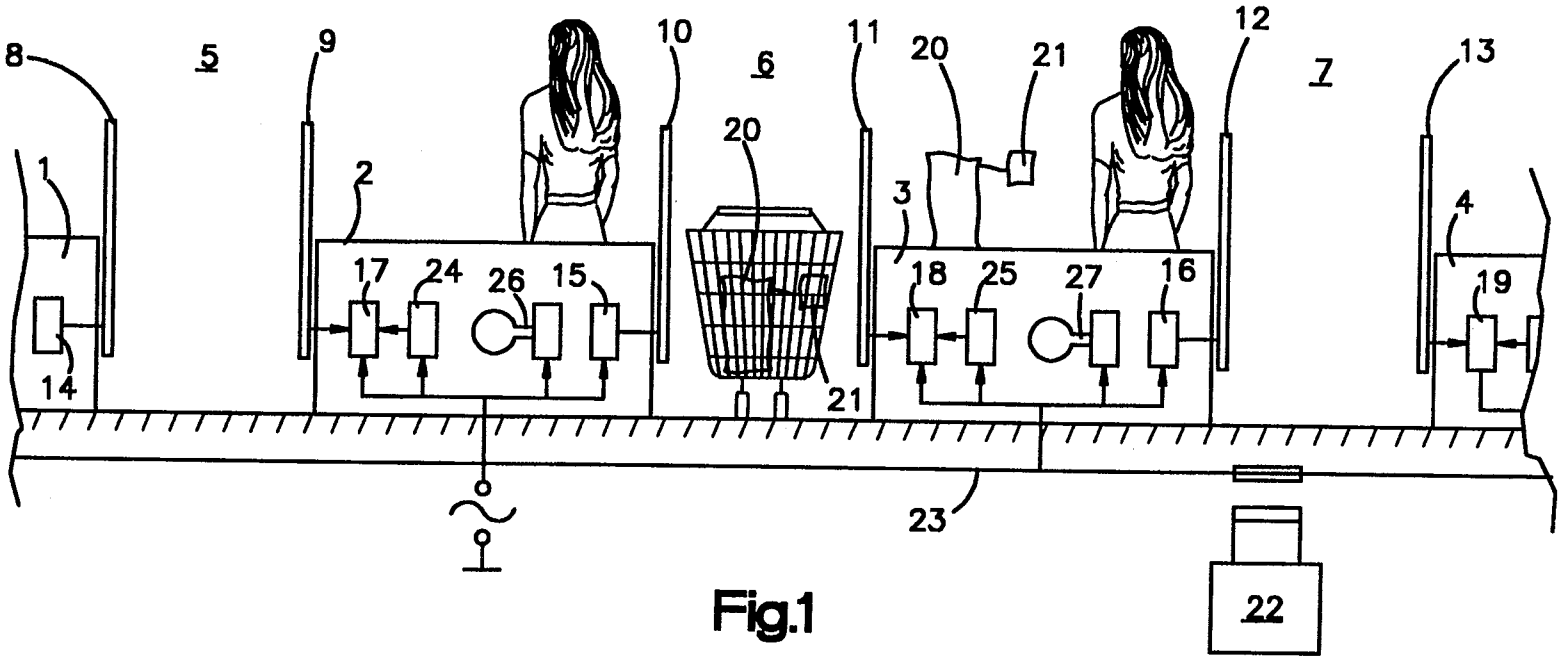
FIG. 1 A detail from a long row of cash register boxes in a supermarket with an apparatus according to the invention installed thereon.

In FIG. 1, 1 to 4 represent four of a larger number of juxtaposed cash register boxes in a supermarket. Between the boxes are left passages 5 to 7 for the customers and these are electronically monitored for shoplifting. For electronic shoplifting monitoring purposes labels are fixed to the goods and provided with an electronic resonant circuit. FIG. 1 shows in exemplified manner two articles 20 provided with such resonant labels 21. For detecting the labels 21 antennas 8 to 13 are fitted laterally to the cash register boxes on either side of the passages. The antennas 8, 10 and 12 are transmitting antennas and the antennas 9, 11 and 13 receiving antennas.

Figure 2:
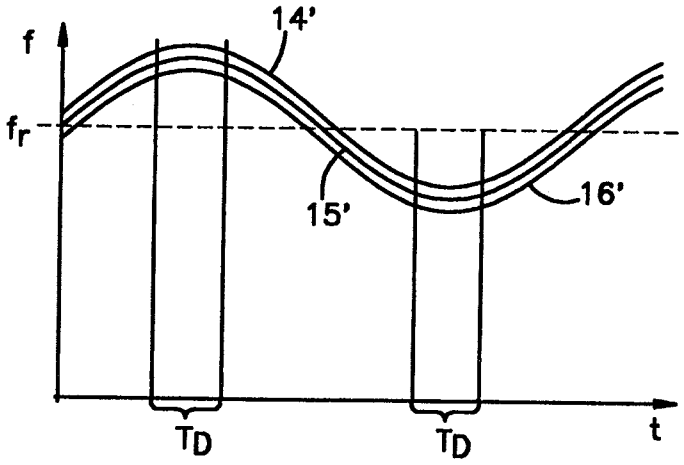
FIG. 2 A frequency-time diagram of three reciprocally frequency-shifted wobble curves.

The transmitting antennas are controlled or supplied by first h.f.-generators 14 to 16, which generate h.f.-oscillations with a frequency of approximately 8.2 MHz. The frequency of 8.2 MHz, which roughly corresponds to the nominal resonant frequency $f_R$ of the labels to be detected, is wobbled with a wobble frequency of approximately 85 Hz across a frequency range of only a few hundred kHz (FIG. 2). FIG. 2 shows wobble curves 14', 15' and 16' of the h.f.-generators 14, 15 and 16 shown in FIG. 1.

The individual wobble curves or cycles and therefore naturally also the h.f.-generators 14, 15, 16 arranged in decentralized manner in the cash register boxes and which generate the same are synchronized with one another, as is apparent from the wobble curves in FIG. 2. A synchronization signal with a frequency or frequency spectrum in the LW-range generated by a unit 22 is used for synchronization purposes. It is coupled into a line 23 of the electrical mains supplying the h.f.-generators 14 to 16 and inter alia the cash registers with electrical power and is transmitted by the said line to the said elements.

Figure 5:
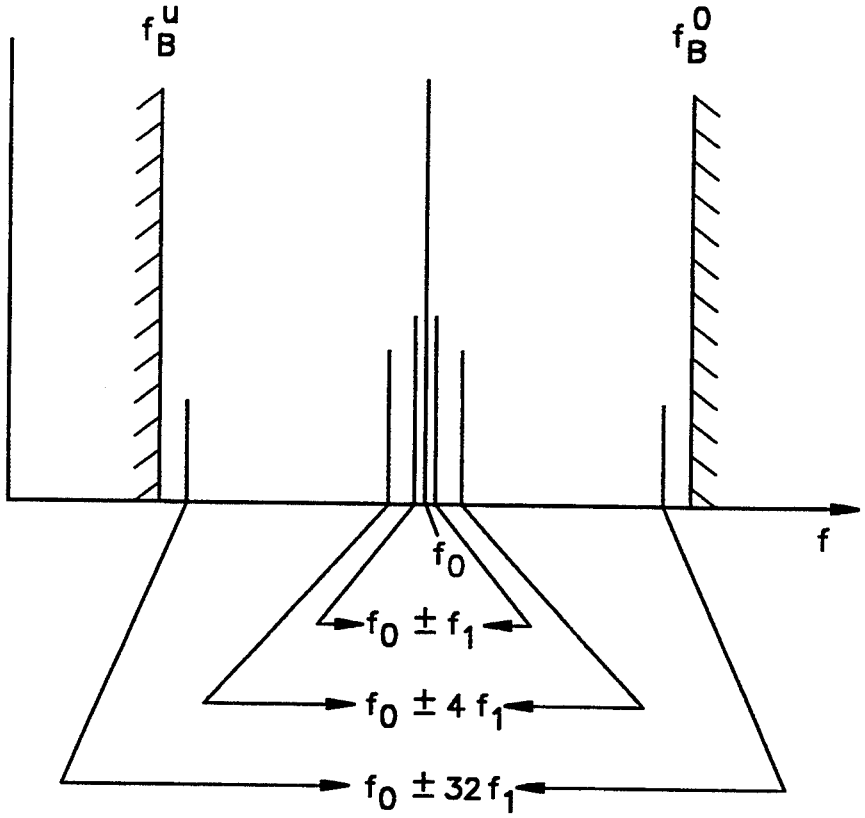
FIG. 5 Diagramatically a frequency spectrum of the synchronization signal.

FIG. 5 diagrammatically shows the frequency spectrum of the synchronization signal in the LW-range. Besides a prevailing carrier frequency $f_0$ (e.g. 145 kHz), there are also secondary frequencies $f_0 \pm f_1$ and $f_0 \pm 4f_1$ and $f_0 \pm 32f_1$. The frequency $f_1$ (preferably 85 Hz) corresponds to the fundamental frequency of the wobble cycles of FIG. 2 and is consequently the fundamental wobble frequency. The frequency spectrum of FIG. 5 is generated in that onto a carrier oscillation with the frequency $f_0$ is modulated the frequency $f_1$ and also 4 and preferably 32 times f. In FIG. 5 are shown in random manner the upper and lower range limits of the frequency band allowed by the postal authorities for data transmission of the electrical mains, being designated $f_B{}^u$ or $f_B{}^o$.

Figure 3:
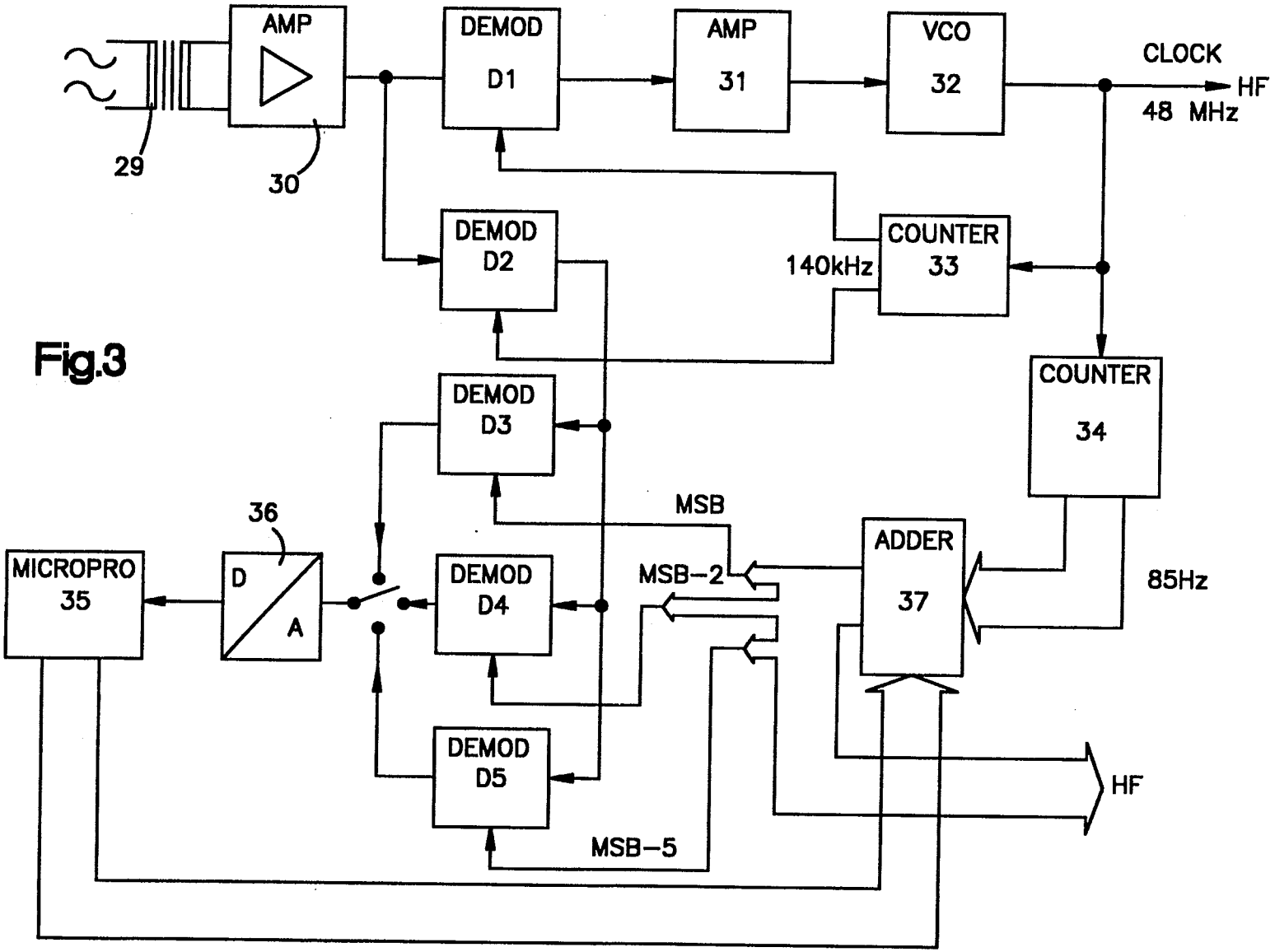
FIG. 3 The block circuit diagram of an embodiment for a synchronization circuit according to the invention with several demodulators D1, . . . ,D5.

The wobble cycles of the individual h.f.-generators are frequency synchronized with one another using the frequency $f_0$ and e.g. so-called PLL circuits. After demodulation, the secondary frequencies are used for producing the desired, coinciding phase position of the individual wobble curves. The block circuit diagram of a preferred embodiment for such a synchronization circuit, which is in each case associated with one of the first h.f. generators 14 to 16 is shown in FIG. 3.

The central component of the synchronization circuit is a voltage-controlled oscillator (VCO) 32, which generates a clock frequency of e.g. 48 MHz as the master frequency for the particular h.f.-generator. By means of counters 33, 34 acting as frequency dividers, from the clock frequency of said VCO 32 is derived the local carrier frequency $f_0$ and the local fundamental wobble frequency $f_1$ and they are coupled in phase-locked manner or brought into phase with the corresponding signals generated in the central unit 22.

Figure 4:
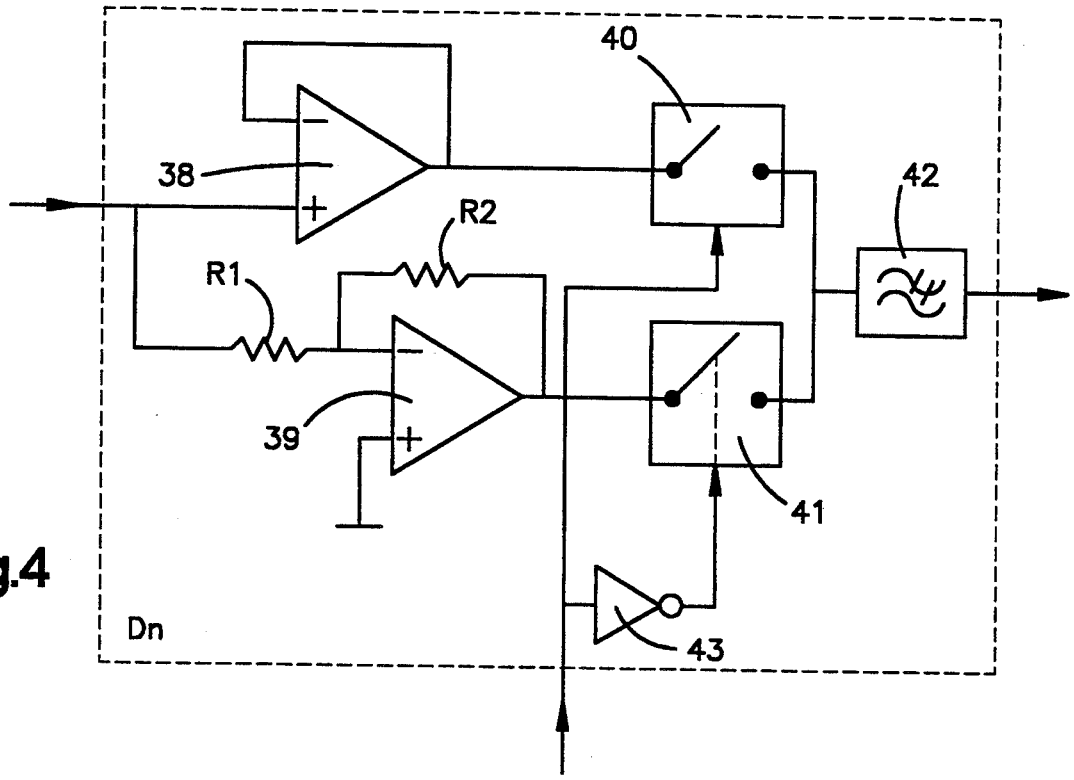
FIG. 4 The block circuit diagram of one of the demodulators D1, . . . , D5 from FIG. 4.

From the mains line (23 in FIG. 1), for this purpose the modulated LW-carrier oscillation is supplied across a coupling transformer 29 and across a following, broad-band LW-amplifier 30 with automatic gain control (AGC) to the inputs of two similar, controllable demodulators D1 and D2, whose internal construction is shown in FIG. 4. In the demodulators D1 and D2 there is in principle a phase-sensitive rectification of the input signal relative to a control signal located at the control input and this will be explained in greater detail in conjunction with FIGS. 4 and 6. The control signals for the two demodulators D1 and D2 are two output signals (square-wave signals) in quadrature of the local carrier frequency $f_0$ (140 kHz) from the first counter 33.

The output signal of the first demodulator D1 is amplified in a following amplifier 31, which preferably has a proportional/integral (PI) characteristic and is used for controlling the VCO 32. The blocks D1, 31, 32 and 33 form the aforementioned PLL control loop, which ensures that the frequency and phase of the locally and centrally generated carrier oscillation are coupled in an identical and locked manner. The output signal of the first demodulator D1 in the steady-state of the control loop is approximately equal to zero and the centrally generated carrier oscillation has a phase difference of ±90° compared with the control signal of the first demodulator D1.

The output signal of the second demodulator D2 is at a maximum due to the quadrature relationship between the control signals, i.e. it changes in accordance with the envelope of the centrally generated, modulated carrier oscillation and therefore represents the demodulated useful signal containing the frequencies $f_1$, $4f_1$ and $32f_1$. This demodulation signal, which contains the fundamental wobble frequency centrally generated in the unit 22, is now used for fixing the phase of the fundamental wobble frequency generated by means of the second counter 34. For this purpose use is once again made of a control loop, which in its simplest extension stage comprises a third demodulator D3, a following A/D converter 36, a microprocessor 35 and an adder 37. The microprocessor 35 can be a component already used for other purposes and which additionally takes on the functions described here.

The second counter 34 has an output, at which is supplied a several (e.g. 16) bit wide word and this reaches a corresponding input of the adder 37 and the same applies with respect to the output of the latter. The bit at the output with the highest weighting is designated in the case of the adder 37 in FIG. 3 as MSB for most significant bit, that with the third largest weighting as MSB-2 and that with the sixth largest weighting as MSB-3. The MSB makes available the locally generated fundamental wobble frequency, MSB-2 the $2^2$th, i.e. the 4th harmonic and MSB-5 the $2^5$th, i.e. the 32nd harmonic of the fundamental frequency. The signal MSB from the output of the adder 37 is used as the control signal of the third demodulator D3. The input signal is constituted by the output signal of the second demodulator, i.e. the demodulated carrier oscillation.

The above-described arrangement from the second counter 34 and the following adder 37 according to FIG. 3 is only one possible embodiment. It is equally conceivable to construct the counter 34 as a loadable counter, so that the addition can be performed directly in the counter 34. The adder 37 is in this case naturally superfluous and the output of the microprocessor 35 is fed directly to the loading input of the counter 34.

If the phase difference between the MSB control signal and the demodulation signal diverges from a value ±90°, then the output signal of the third demodulator D3 is not equal to zero. This output signal is then converted in the following A/D-converter 36 into a digital value, which is further processed by the microprocessor 35. In accordance with the digital input value, the microprocessor 35 supplies an incremental number, which is added in the adder 37 to the numbers from the counter 34 and therefore causes a phase shift of the square-wave signal of the MSB output. This shift in the control loop takes place until the MSB signal and the demodulation signal have a fixed phase difference of ±90°.

As this type of phase control is relatively approximate, preferably fine controls are made, in that following the above-described tuning to the fundamental wobble frequency, there is successively a corresponding tuning to the 4th or 32nd harmonic. For this purpose, parallel to the third demodulator are provided a fourth and a fifth demodulator D4 and D5, which receive the same input signal (demodulation signal), but as the control signal the output signals MSB-2 or MSB-5 of the adder 37. The outputs of the demodulators D3 to D5 can be connected as required and in particular successively to the input of the A/D-converter 36 by means of the switch diagrammatically shown in FIG. 3. In this way, successively and with ever finer tuning the phase of the MSB signal at the output of the adder 37 can be oriented with the phase of the centrally generated fundamental wobble frequency. The value at the output of the adder 37 coupled in phase-locked manner to the centrally generated fundamental wobble frequency can be correspondingly used in the associated h.f.-generator.

The exemplified, internal construction of one of the demodulators D1, . . . , D5 (Dn) is shown in the block circuit diagram of FIG. 4. To the common signal input are connected in parallel a normal amplifier 38 and an inverting amplifier 39 (with voltage dividers R1=R2) and whose outputs are connected by means of controllable similar switches 40, 41 to a common low-pass filter 42. The first controllable switch 40 is directly controlled by the control signal at the common control signal input and the second switch 41 across an inverter 43.

Figures 6A, 6B, 6C, 6D, 6E, 6F, 6G, 6H:
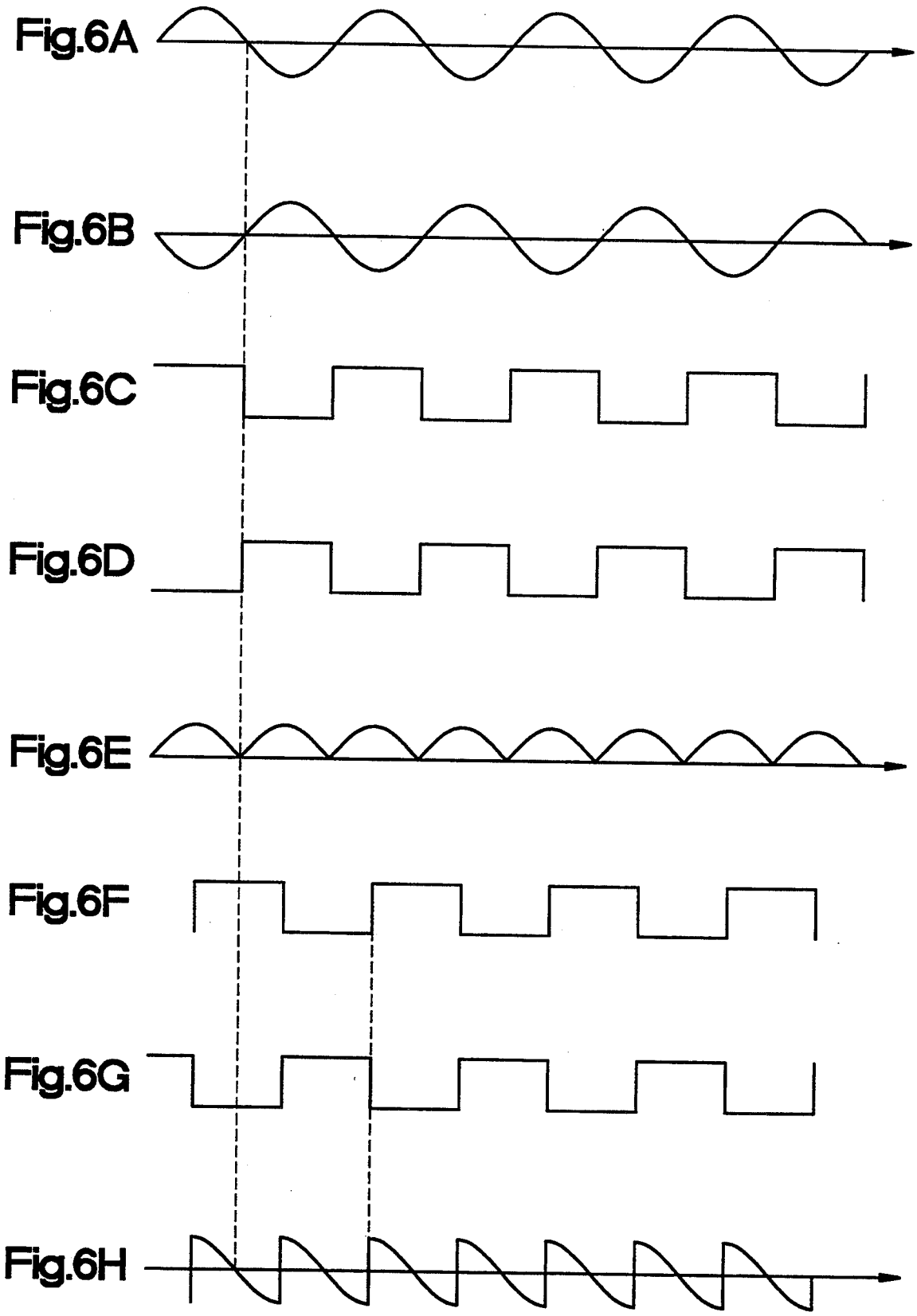
FIGS. 6A–6H Various signal shapes occurring in one of the demodulators D1, . . . ,D5.

The signals occurring in the circuit according to FIG. 4 are shown in FIG. 6. If there is a sinusoidal oscillation according to FIG. 6(*b*) at the signal input of the demodulator Dn, then it appears in inverted form at the output of the inverting amplifier 39 according to FIG. 6(*a*), and in normal form at the output of the amplifier 38 according to FIG. 6(*b*). If a square-wave signal of the same frequency, but whose phase is shifted by 180° is now supplied to the common control input of the demodulator Dn according to FIG. 6(*c*), both controllable switches 40, 41 are alternately opened and closed in such a way that at the input of the low-pass filter 42 is obtained the signal shown in FIG. 6(*e*) and which is characteristic for a full-wave rectification of the original sinusoidal signal. However, if the square-wave control signal is phase-shifted by 90°, as shown in FIG. 6(*f*) or (*g*), at the input of the low-pass filter 42 occurs the signal shown in FIG. 6(*h*), which has equally large positive and negative voltage faces and therefore gives zero following averaging in the low-pass filter 42. The case shown in FIG. 6(*a*)–(*e*) occurs in the second demodulator D2, whilst the case shown in FIG. 6(*f*)–(*h*) relates to the other demodulators D1 and D3, . . . , D5.

The phase position can fundamentally also be obtained by a "listening to one another" of the individual transmitter-receiver pairs, but such a process is very complicated to carry out, at least for as long as the individual phases differ significantly from one another. However, in this way it is advantageously possible to carry out a fine adjustment, in the phase position, whilst evaluating the aforementioned secondary frequencies, has substantially already been obtained in the desired form.

If e.g. a building houses several shops, which independently of one another are equipped with shoplifting prevention installations of the aforementioned type, synchronization problems can occur, if all or at least two of these installations, independently of one another, feed into the electrical mains a synchronization signal with the same frequency. However, an undesired reciprocal influencing of the independent installations can easily be avoided in that the frequencies of the synchronization signals of the different installations are chosen so as to differ from one another. It must also be ensured that the secondary frequencies also adequately differ from one another.

If an attempt is made to smuggle the articles 20 secured with the labels 21 in unpaid from through one of the passages 5 to 7 (such as e.g. the article 20 located in the trolley in passage 6), the resonant circuits of these labels are excited to oscillate by the electromagnetic waves radiated from the transmitting antennas. Most of the oscillation energy linked with this oscillation is radiated again from the labels in the form of electromagnetic waves. Besides the electromagnetic waves directly radiated from the transmitting antennas, said waves can be received by means of the receiving antennas. However, the receiving antennas are constructed in such a way (e.g. subdivided into two oppositely oriented partial surfaces of the same size), that most of the high frequency emanating directly from the transmitting antennas is eliminated by self-cancelling in the antenna for far zone suppression purposes. The receiving circuits 17 to 19 connected to the receiving antennas are used for discriminating the very weak label signals from the still remaining high frequency emanating directly from the transmitting antennas, as well as the background, etc. If successful, the receiving circuit triggers an alarm. For discrimination of the label signals, inter alia in the input area of the receiving circuits 17 to 19 is provided a not shown mixer or analog multiplier, in which the signals from the receiving antennas are multiplied by a high frequency signal, which is generated by second h.f.-generators 24, 25 especially provided for this purpose. The second h.f.-generators generate a h.f.-oscillation, which coincides with that for controlling the transmitting antenna belonging to the same passage and which is located on the other side thereof. Thus, the h.f.-oscillation generated by the second h.f.-generator 25 corresponds to that of the first h.f.-generator 15. By means of the synchronization signal transmitted across the energy supply line 23, the second h.f.-generators can be synchronized with their in each case associated first h.f.-generators.

As can be gathered from FIG. 2, the sinusoidally selected wobble curves are somewhat reciprocally displaced on the frequency axis, but their reciprocal frequency displacement is chosen so small compared with the frequency deviation (frequency amplitude of the wobble curves), that all the wobble curves (also the other first h.f.-generators located outside the detail of FIG. 1) intersect the nominal frequency $f_R$ with their roughly linear portions between their maxima and their minima. However, preferably, all the wobble curves do not merely intersect the nominal frequency $f_R$, but also a certain frequency band $f_R+df$ around the nominal frequency, in order to take account of tolerances of the resonant frequency of the resonant labels resulting from manufacture. As a result of the reciprocal frequency displacement and the synchronism of the wobble curves, it is ensured that the first h.f.-generators at all times generate frequencies differing from one another. In that the receiving circuits 17 to 19 are constructed in such a way that they receive in a sufficiently narrowband manner only on the frequency of the first h.f.-generator belonging to the same passage, advantageously a substantially complete neutralization of the individual pairs of transmitting/receiving units is obtained.

In FIG. 1, 26 and 27 indicate deactivators located in the cash register boxes. These deactivators deactivate labels fixed to articles which have been correctly paid for. The deactivators can be synchronized by means of the synchronization signal, transmitted via the line 23, with the receiving circuits 17 to 19. There is an excellent neutralization of the label detection and the label deactivation, in that the receiving circuits are rendered inactive for the time intervals designated $T_D$ in FIG. 2 and which are not usable for label discrimination purposes, whilst the deactivators are active exclusively during these times.

The above-described, electronic units located in the individual cash register boxes, can advantageously be combined into a single unit.

It is obvious that the invention is not restricted to the embodiment explained, in which the transmitting and receiving antennas are fitted laterally to the cash register boxes. The antennas could equally well be positioned in free-standing manner at the exit and not installed in conjunction with the cash register boxes. In this case, the transmitting and receiving antennas positioned between two passages must be closely juxtaposed and in particular located in the same plane, because optically the juxtaposed transmitting and receiving antennas can be constructed as a single component. As a result of a suitable geometrical construction of the antennas, it can also be ensured that the reception via the receiving antennas is not excessively impaired by the proximity of the transmitting antennas. An example for this is constituted by the aforementioned twisting together of the receiving antennas.

I claim:

1. Apparatus for the detection of labels (21) for the prevention of the shoplifting of goods (20), said labels being provided with an electrical resonant circuit having a resonant frequency ($f_R$) in the MHz range, the apparatus comprising a plurality of pairs of transmitting and receiving antennas (8 to 13), which in each case bound passages (5 to 7) which are to be monitored, in which the transmitting antennas (8, 10, 12) of the pairs in each case radiate electromagnetic waves, the frequency of which is wobbled in wobble cycles with a fundamental wobble frequency ($f_1$) over the predetermined resonant frequency of the labels, the wobble cycles of all the pairs being synchronized with one another and in which to the receiving antenna (9, 11, 13) of each pair is connected a receiving circuit (17 to 19) for detecting the presence of a label, characterized in that the radiated electromagnetic waves are generated by decentralized h.f. -generators (14 to 16) in each case individually associated with the transmitting antennas and that the wobble cycles are synchronized with one another using a synchronization signal with at least one frequency different from the resonant frequency ($f_R$) generated in a central unit (22) and supplied to the h.f.-generators.

2. Apparatus according to claim 1, characterized in that the synchronization signal has a carrier oscillation with a carrier frequency ($f_0$), that this carrier oscillation is modulated with a modulation frequency comprising at least the desired fundamental wobble frequency ($f_1$) of the wobble cycles and that the carrier frequency ($f_0$) is used for fixing the frequency of the wobble cycles and the modulation frequency for fixing the phase of the wobble cycles.

3. Apparatus according to claim 2, characterized in that, in addition to the fundamental wobble frequency ($f_1$), the modulation frequency comprises at least one harmonic, preferably the 4th and 32nd harmonics of the fundamental wobble frequency ($f_1$).

4. Apparatus according to claim 2, characterized in that:

(a) with each of the h.f.-generators (14 to 16) is associated a local, voltage-controlled oscillator VCO (32), which generates a local clock frequency, (b) for each VCO (32) first means are provided in order to derive from the local clock frequency, by dividing down, the carrier frequency ($f_0$) and the fundamental wobble frequency ($f_1$), (c) for each VCO (32) second means are provided, in order to bring the carrier frequency ($f_0$) derived from the VCO into a fixed phase relationship to the synchronization signal generated in the central unit (22), (d) for each VCO (32) third means are provided, in order to bring the fundamental wobble frequency ($f_1$) derived from the VCO into a fixed phase relationship with the fundamental wobble frequency ($f_1$) modulated onto the carrier oscillation.

5. Apparatus according to claim 4, characterized in that:

(a) the first means comprises two counters (33, 34), the first counter (33) divides down to the carrier frequency ($f_0$) the frequency delivered by the VCO (32) and at two different outputs delivers control signals, in quadrature, in the form of square-wave signals with the carrier frequency ($f_0$) and the second counter (34) delivers the fundamental wobble frequency ($f_1$) at its output as the most significant bit (MSB), (b) the second means comprises a controllable demodulator (D1), to whose signal input is supplied the modulated carrier oscillation and whose output signal is used for controlling the VCO (32), and (c) the demodulator (D1) is so controlled by the first control signal of the first counter (33), that between the carrier oscillation at the signal input of the demodulator (D1) and the first control signal there is a fixed phase difference of $\pm 90°$.

6. Apparatus according to claim 5, characterized in that:

(a) the third means comprise a second and third control demodulator (D2, D3), in each case the same as the first recited control demodulator, an adder (37), an analog/digital converter (36) and a microprocessor (35), (b) the modulated carrier oscillation is supplied to the signal input of the second demodulator (D2) and the second demodulator (D2) is controlled by the second control signal of the first counter (33)

(c) the adder (37) has two inputs, whereof one is connected to the output of the second counter (34) and the second to an output of the microprocessor (35), (d) the output signal of the second demodulator (D2) is supplied to the signal input of the third demodulator (D3) and the third demodulator (D3) is controlled by an output signal, which comes from the output of the adder (37) as the most significant bit, and (e) the output signal of the third demodulator (D3) is supplied across the A/D converter (36) to an input of the microprocessor (35), which together with the adder (37) and the third demodulator (D3) forms a control loop for the phase regulation of the output signal of the adder (37).

7. Apparatus according to claim 6, characterized in that for the fine adjustment of the phase of the adder output signal:

(a) parallel to the third demodulator is provided a fourth and fifth demodulator (D4 and D5) in each case the same as the third, (b) the output signal of the second demodulator (D2) is supplied to the signal inputs of the fourth and fifth demodulator (D4 or D5) and the fourth demodulator (D4) is controlled by an output signal, which comes from the output of the adder (37) as the third most significant bit (MSB-2) and the fifth demodulator (D5) is controlled by an output signal, which comes from the output of the adder (37) as the sixth most significant bit (MSB-5) and (c) the outputs of the third, fourth and fifth demodulators (D3 or D4 or D5) can, as desired, be applied to the input of the A/D converter (36).

8. Apparatus according to claim 5, characterized in that the demodulator comprises an inverting amplifier (39) and an amplifier (38) connected in parallel, the inputs of which are connected to the common signal input of the demodulator and the outputs of which lead across two similar, controllable switches (40, 41) to the input of a low-pass filter (42), one controllable switch (40) being controlled by a control signal at the common control input of the demodulator and the other controllable switch (41) being controlled by the inverted control signal.

9. Apparatus according to claim 1, characterized in that, for each pair of transmitting and receiving antennas, there is connected to the associated receiving circuit the same h.f.-oscillation as is supplied to the transmitting antenna of the same pair.

10. Apparatus according to claim 9, characterized in that the h.f.-oscillations in each case supplied to the receiving circuits are generated by especially provided, also decentralized, second h.f.-generators (24, 25) individually associated with the receiving circuits and these second h.f. generators are synchronized with one another and with the h.f.-generators using the synchronization signal.

11. Apparatus according to claim 10, characterized in that between two passages, in each case a first and a second h.f.-generator, as well as a receiving circuit are integrated into a unit.

12. Apparatus according to claim 1, characterized in that the synchronization signal is transmitted to the electrical mains by means of a line (23) thereof and to which are also connected the h.f.-generators and the receiving circuits and that at least one frequency of the synchronization signal is in the long-wave (LW)-range.

13. Apparatus according to claim 1 characterized in that the frequency of the signals irradiated across the transmitting antennas is sinusoidally wobbled over the predetermined resonant frequency of the labels and that the receiving circuits are put out of operation for a predetermined time ($T_D$) in the vicinity of the maximum and minima of the sine curve.

14. Apparatus according to claim 1, characterized in that the electromagnetic waves radiated by the transmitting antenna of each pair are wobbled over the predetermined resonant frequency of the labels in a manner so as to be frequency shifted with respect to the electromagnetic waves radiated by the transmitting antenna of each other pair, that the receiving circuit of each pair only receives in narrow-band manner on the particular transmitting frequency of the transmitting antenna belonging to the same pair and that the wobble cycles of all the pairs have the same phase position.

15. Apparatus according to claim 1, characterized in that the transmitting and receiving antennas located between two passages are fitted in reciprocally spaced manner, e.g. on either side of the cash register boxes provided.

16. Apparatus according to claim 1, characterized in that the transmitting and receiving antennas located between two passages are fitted in closely juxtaposed manner in substantially the same plane.

* * * * *